US005174427A

United States Patent [19]

Glaser

[11] Patent Number: 5,174,427

[45] Date of Patent: Dec. 29, 1992

[54] DISK-ENABLED ACTUATOR

[75] Inventor: Robert L. Glaser, Appleton, Wis.

[73] Assignee: L. M. Becker & Co., Inc., Appleton, Wis.

[21] Appl. No.: 773,381

[22] Filed: Oct. 7, 1991

[51] Int. Cl.[5] ..... G07F 5/04

[52] U.S. Cl. ..... 194/236; 194/237; 194/255

[58] Field of Search ..... 194/236, 237, 255

[56] References Cited

U.S. PATENT DOCUMENTS

| | | | |
|---|---|---|---|
| 2,684,143 | 7/1954 | Obodzinski | 194/255 |
| 3,028,049 | 4/1962 | Eppy . | |
| 3,185,282 | 5/1965 | Kovar | 194/236 |
| 3,249,197 | 5/1966 | Smith et al. | 194/236 |
| 3,592,306 | 7/1971 | Dunn | 194/255 |
| 3,604,547 | 9/1971 | Bolen . | |
| 3,756,366 | 9/1973 | Greenwald . | |
| 3,822,004 | 7/1974 | Bolen . | |
| 3,894,657 | 7/1975 | Eckmayr . | |
| 4,350,239 | 9/1982 | Tsuiki | 194/236 |
| 4,440,312 | 4/1984 | Glaser . | |
| 4,673,074 | 6/1987 | McCormick | 194/236 |
| 4,679,684 | 7/1987 | Glaser . | |
| 4,815,578 | 3/1989 | Bonanno | 194/237 |
| 4,899,864 | 2/1990 | Van Horn | 194/237 |
| 5,070,986 | 12/1991 | Hoffman et al. | 194/237 |

FOREIGN PATENT DOCUMENTS

| | | | |
|---|---|---|---|
| 534778 | 12/1956 | Canada | 194/236 |
| 534932 | 12/1956 | Canada | 194/236 |
| 1474755 | 7/1969 | Fed. Rep. of Germany | 194/236 |

*Primary Examiner*—Michael S. Huppert
*Assistant Examiner*—William M. Hienz
*Attorney, Agent, or Firm*—Quarles & Brady

[57] ABSTRACT

Disclosed herein is a coin rejector for accepting multiple coins. Upon sequential insertion of two coins of the desired size, a customer can rotate a handle to operate a vending machine. The device employs a rotatable wheel which accepts the disks, positions them adjacently edge-to-edge such that the outer edge of the second disk disables a blocking member which otherwise prevents vending, and deposits the disks into a collection chamber.

1 Claim, 3 Drawing Sheets

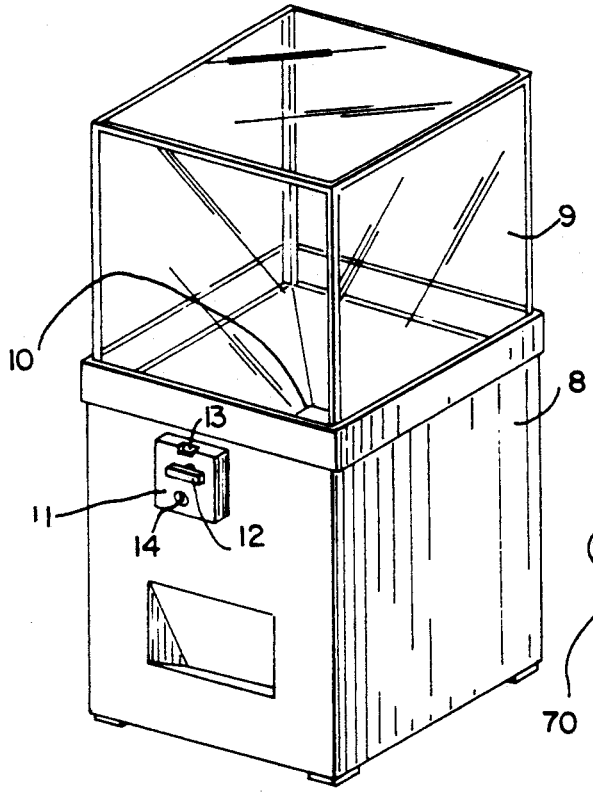
FIG. 1
(PRIOR ART)
FIG. 4
(PRIOR ART)
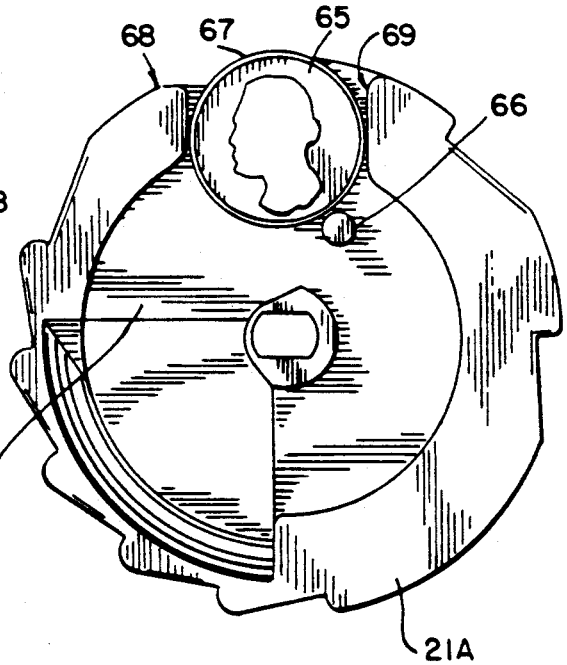
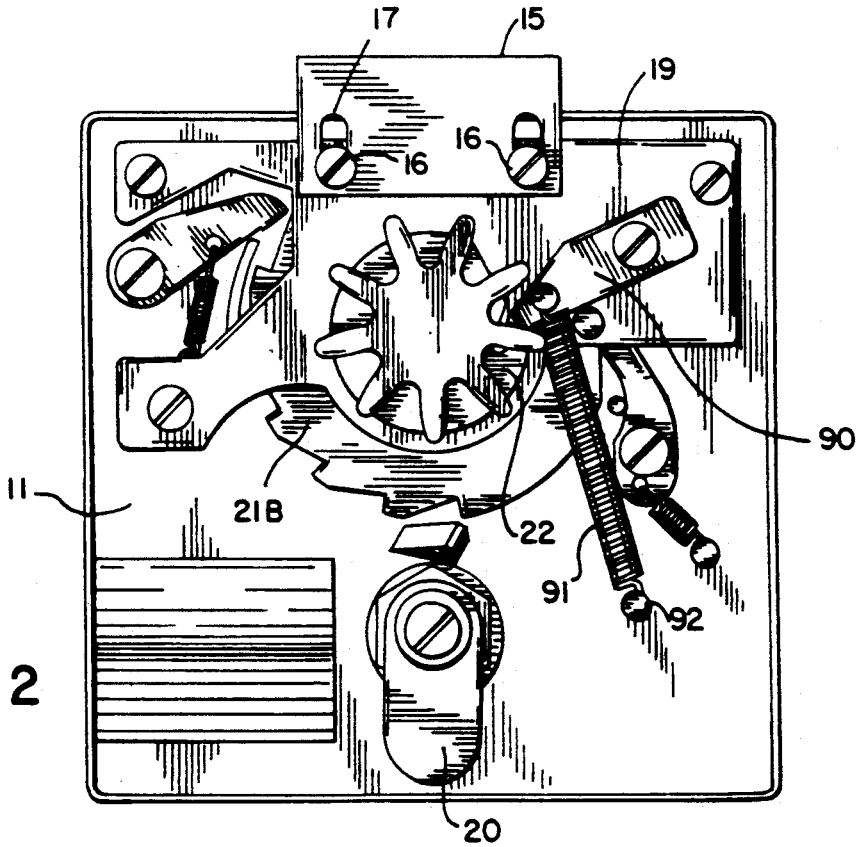
FIG. 2

DISK-ENABLED ACTUATOR

BACKGROUND OF THE INVENTION

1. Field of the Invention

This invention relates to machines which vend or dispense a product (or grant entry) upon the insertion of at least two disks (e.g. coins) of a desired size. It appears to be especially suitable to be used to convert a mechanical coin rejector from a single quarter coin actuator into a fifty cent coin actuator.

2. Description of the Art

In one type of a widely used coin rejector, inserting a single coin in the coin rejector mechanically disables a blocking means and allows the customer to rotate an external handle. See e.g. U.S. Pat. Nos. 3,028,049, 3,604,547, 3,756,336 and 3,822,004. This type of prior art actuator/rejector is designed to prevent insertion of any coin which is larger than the desired coin, and to reject coins which are too small.

With such systems, when it is necessary to increase the price of vending (e.g. due to inflation or to a change of merchandise), one usually has to replace the entire actuator. Some systems have been tried which require the public to sequentially insert coins into multiple slots. However, the public does not readily understand these multiple slot systems. There is therefore a need for an improved way to modify single coin actuators to accept multiple coins.

SUMMARY OF THE INVENTION

In one aspect, the invention provides a disk-enabled actuator of the type in which there is a rotatable director having a peripheral opening therein. The director is normally restricted from free rotation by an adjacent peripheral blocking means. When a disk of a selected diameter is positioned in the opening so as to extend peripherally outward therefrom, the disk contacts and releases the blocking means upon rotation of the director.

The improvement is that the director is provided with a first restricted passageway communicating with the opening which is constructed and arranged such that disks smaller than the selected diameter may pass through the first passageway. Also, a first disk of the selected diameter will be retained in the first passageway. Upon subsequent attempted rotation of the director, the first disk will not, by itself, act to release the rotational blocking means. Upon insertion of a second disk of the same selected diameter in the director opening, the first disk will support the second disk such that the second disk projects peripherally outwards from the director. Upon attempted rotation of the director with both the first and second disks therein, the second disk release the rotational blocking means.

In a preferred aspect of the invention, the director also has a second passageway extending from the opening which is sized and constructed such that when said first disk is in said first passageway and a disk of below a selected size is inserted in the opening, the under size disk will pass through the second passageway. The disks are preferably coins, the actuator is preferably for controlling vending in a vending machine, and the director is preferably in the form of a rotatable plate.

It will be appreciated that the invention provides an improvement in a rotary disk (e.g. coin) enabled actuator. The improvement relates to the design of a part (which is referred to above as the "director") that accepts coins of the correct diameter range, rejects others, and most importantly allows vending only upon insertion of at least two coins. The director will accept the first correct size coin, but denies rotation until the second such coin has been inserted. It positions the first and second correct size coins such that the second will rest upon the first edge-to-edge. The outer edge of the second will then be in position to disable the blocking member and thereby allow rotation. Upon rotation, both coins are deposited into the collection chamber.

It is therefore an object of the invention to provide an inexpensive modification of existing coin-enabled mechanical actuators so that two coins of the same size, rather than just one, are required in order to actuate vending.

It is another object to do so in a manner that permits rejection of inappropriate size coins.

It is yet another object to provide such an actuator that the public will readily understand how to use.

These and other objects and advantages of the invention will be apparent from the description which follows. The preferred embodiments will be described with reference to the accompanying drawings. These embodiments do not represent the full scope of the invention. Rather, the invention may be employed in other embodiments. Reference should therefore be made to the claims herein for interpreting the breadth of the invention.

BRIEF DESCRIPTION OF THE DRAWINGS

FIG. 1 is a perspective view, from the front, top and right, of a prior art vending machine with a coin-enabled actuator;

FIG. 2 is a rear elevation view of the coin-enabled actuator of FIG. 1, but with the actuator of the present invention substituted for the prior art actuator and with several other modifications;

FIG. 4 is a front elevational view of a prior-art coin director;

DESCRIPTION OF THE PREFERRED EMBODIMENTS

Figure 3:
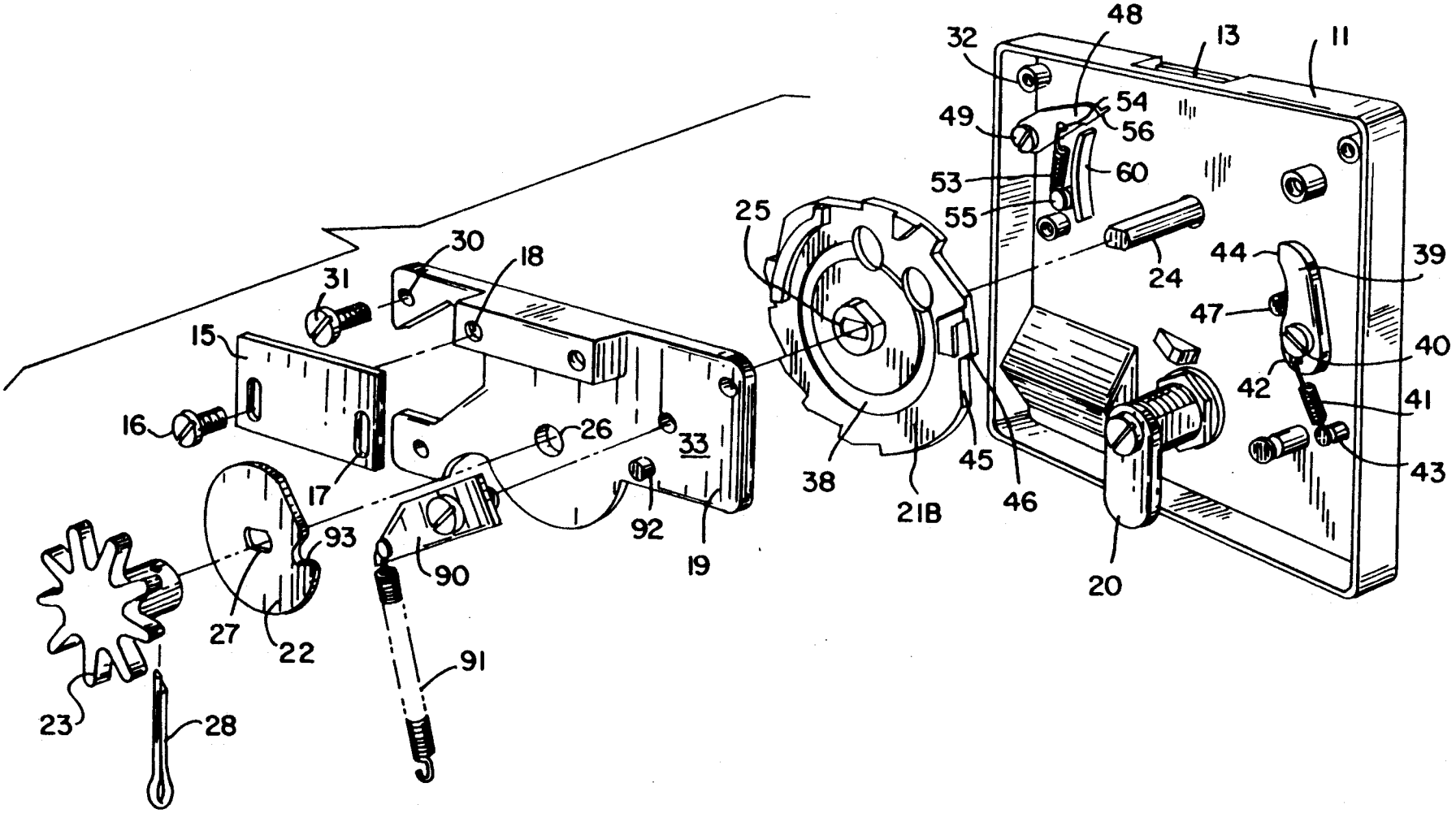
FIG. 3 is an exploded perspective view of the actuator of FIG. 2.

FIG. 1 shows, in simplified form, a prior art vending machine 8 in which the director of the present invention might be used. If desired, the bottom wall 10 of the vending chamber 9 could hold a vending apparatus (e.g. that of U.S. Pat. No. 4,440,312). Appearing on the front of vending machine 8 are the actuator face plate 11, operating handle 12, coin slot 13 and keyhole 14. As best understood from FIGS. 2-4, the coin-enabled actuator of the present invention (or just the director portion of it) can replace the corresponding parts in the prior art design.

Face plate 11 is mounted into a suitable opening in the vending machine front wall by inserting stationary lip 15 (which is bolted to face plate 11 by bolts 16 which passes through slots 17 into hole 18 in retaining plate 19) behind the front wall of the vending machine 10 at the top of the opening, and by using a key in keyhole 14 to rotate movable lip 20 into position behind the front wall of the vending machine 10 (at the bottom of the opening).

Coin director 21B, ratchet wheel 22 and actuating gear 23 are mounted over the shaft 24 of handle 12 by means of slot 25, hole 26, slot 27 and cotter pin 28. The coin director, ratchet wheel, and actuating gear, but not the retainer plate 19, rotate along with the shaft 24.

Figure 6:
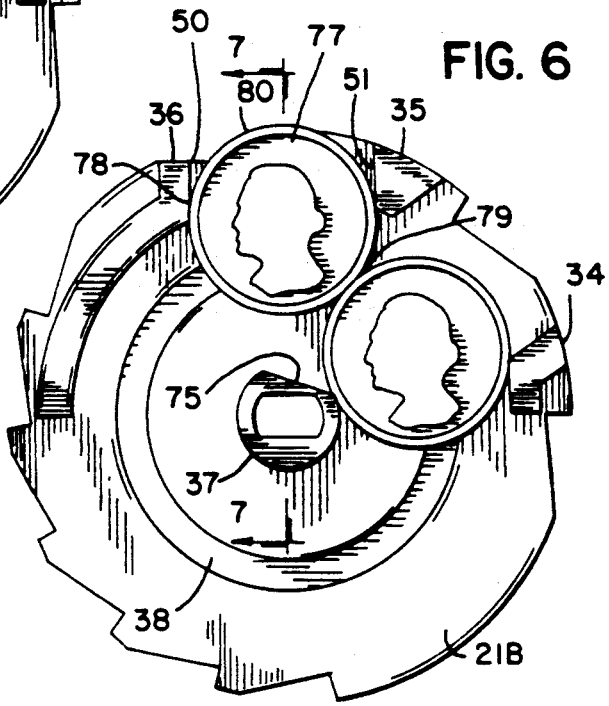
FIG. 6 is similar to FIG. 5, but showing that a second such coin has been deposited.
Figure 7:
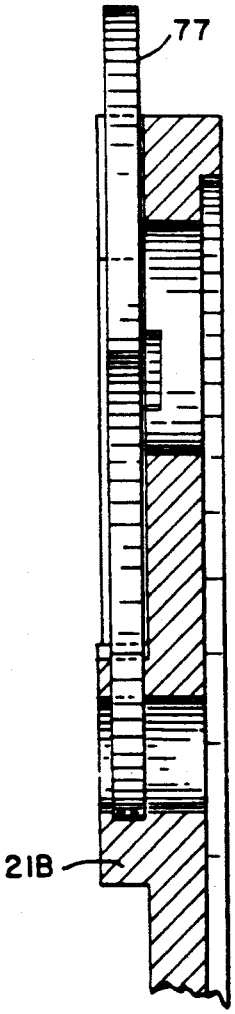
FIG. 7 is a sectional view taken along plane 7—7 in FIG. 6.
Figure 8:
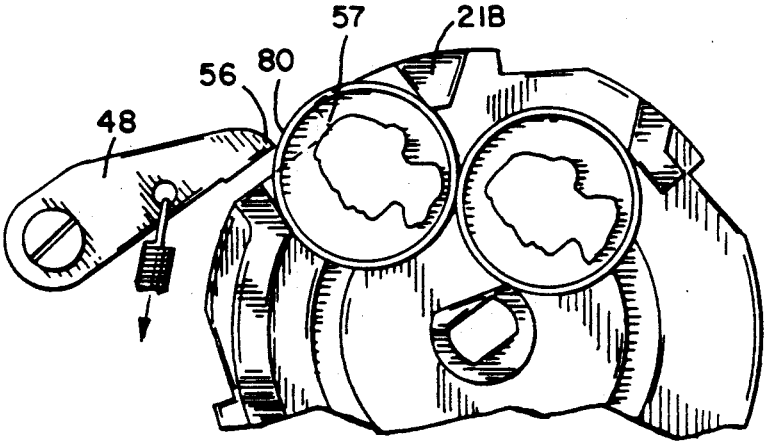
FIG. 8 is an enlarged partial view of the director of FIG. 6, partially rotated, showing the second coin about to engage and disable a blocking element.

Retainer plate 19 is attached to face plate 11 through holes 30 by bolts 31 screwed into threaded spacers 32. The inner lateral surface (i.e., the lateral surface opposite surface 33 of FIG. 3) of retainer plate 19 forms one wall of a narrow chamber and passageway for coins. The other wall is formed by adjacent surfaces of coin director 21. As seen in FIG. 7, spacing between coin director 21B and retainer plate 19 is achieved at every angle of rotation, while allowing gaps for the passage of coins. As will be appreciated from FIG. 6, elevations 34, 35 and 36 and shaft housing 37 on coin director 21B serve this purpose. There is also a projection (not shown) which extends toward coin director 21 from retainer plate 19 which rides in guide track 38 of coin director 21B.

Pawl 39, which is free to rotate on shaft 40 (whose threaded end is screwed into a hole in face plate 11), is provided to assist in preventing reverse rotation (clockwise in the view of FIGS. 2, 3, 5, 6 and 8). Spring 41, which is stretched between hole 42 on pawl 39 and pin 43 (which is press fitted into the face plate), forces tip 44 of pawl 39 to slide along ramps 45 and other outer edges of coin director 21 as coin director 30 rotates so as to engage a blocking edge 46 (see FIG. 3) if the disk director 30 is moved in reverse rotation. Peg 47 is positioned to restrict slightly the descent of pawl 39 in order to prevent tip 44 of pawl 16 from being jammed in the corner formed by ramp 45 and blocking edge 46.

Pawl 48, which is free to rotate on shaft 49 (whose threaded end is screwed into a hole in face plate 11), is provided to prevent forward rotation unless two correct coins are present in coin director 21. Correct coins are those having a diameter small enough to enable it to fit between edges 50 and 51 (see FIG. 6) and large enough to be stopped inside the director. Director 21 is located directly under slot 13 of face plate 11, which allows the insertion of a coin into the opening 50/51. A complete revolution of the handle 12 causes a complete revolution of actuating gear 23, the teeth of which engage and actuate a vending, opening or other mechanism in a conventional manner (see e.g. U.S. Pat. No. 3,877,004), and allows the coins to fall into a collection chamber. Note that yet another similar pawl system is shown in FIG. 2 (90–93) which provides further resistance to reverse rotation by resisting reverse rotation of ratchet wheel 22.

It is useful at this point to review in more detail the prior art "single coin" director 21A shown in FIG. 4. Coin 65 rests upon peg 66 which is positioned such that the edge 67 of coin 65 protrudes beyond ramp 68. Upon forward rotation of coin director 21A, tip 56 of pawl 48 will be forced upward by edge 67 of coin 65 such that the pawl misses blocking edge 69. A larger coin cannot be inserted. Too small a coin will fall into passageway 70 and then into a coin collecting chamber (and thus be "rejected"). Such systems are sometimes also used with axial pawls mounted on the retainer plate that send a pawl tip through the plate to interfere with blocking edge 69 when the coin is not present.

Figure 5:
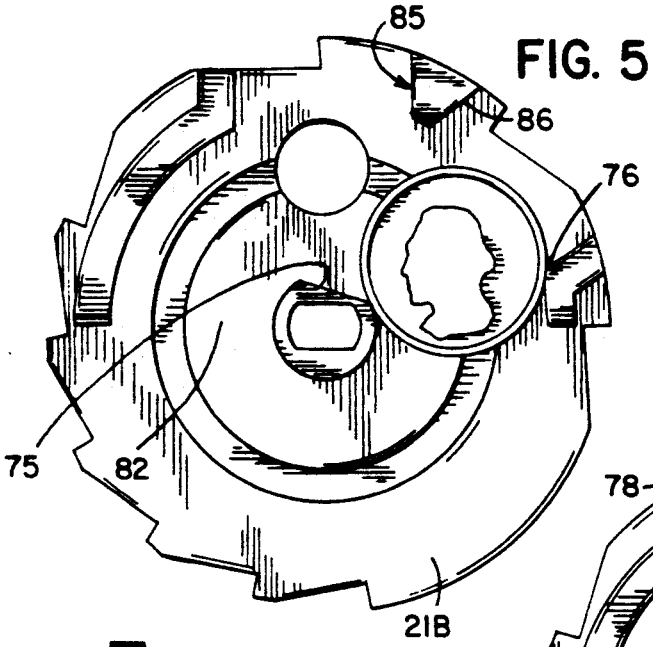
FIG. 5 is a front elevational view of the FIG. 2 coin director, into which one coin has been deposited.

The preferred present invention instead employs coin director 21B shown in FIGS. 5, 6, 7 and 8. As shown in FIG. 5, when the first correct coin is inserted into that slot, it drops and moves along ramp 75 until it is stopped and positioned by a restriction formed by the lower end of ramp 75 and edge 76. Too large a coin cannot enter the director. Too small a coin will fall through and thus be "rejected" into the coin collection box. When another correct coin 77 is inserted into the slot formed by edges 50 and 51, it is stopped and positioned by edge 78 and by the edge 79 of the first coin 18. As a result, outer edge 80 of second coin 77 is available to lift pawl 48 (or if axial pawls are used, to move the axial pawl), causing pawl tip 56 to avoid engaging blocking surface 57, thereby allowing forward rotation of the coin director and the other components which rotate with the shaft of the handle. If the second coin is too small, it will fall through passageway 82 and be rejected and collected. Note that two exits 85 and 86 are provided so that when the director turns 180°, both can provide quick exit paths for the two non-rejected coins.

From the description above, it should be apparent that the present invention meets the need to modify existing actuators to accept and reject selected multiple coins. To achieve price increase, the only requirement is the replacement of the existing single coin director with a coin director embodying the present invention. The improved coin director can be manufactured out of conventional materials such as metals and plastics. The public will readily understand how to use the device (e.g. drop two identical coins, one after another in slot 13).

Although the preferred embodiment of the invention has been described above, the invention claimed herein is not restricted to that embodiment. In this regard, there may be various other modifications and changes to the embodiment which are within the scope of the invention. For example, another embodiment of the present invention may be to accept three or more coins of the correct dimension and position them such that the edge of the last inserted coin would engage a rotation blocking means and allow rotation, initiation of vending mechanism, and capture of the disks. In any event, the invention is not to be limited by the specific description above, but should be judged by the claims which follow.

I claim:

1. In a disk-enabled actuator of the type in which a rotatable disk director having a peripheral opening therein is normally restricted from free rotation by an adjacent peripheral blocking means, and of the type in which, when a disk of a selected diameter is positioned in the opening so as to extend peripherally outward therefrom, the disk can contact and release the blacking means upon rotation of the director, the improvement comprising:

the director having a first restricted passageway communicating with the opening which is constructed and arranged such that:

(a) disks smaller than a selected diameter may pass through the first restricted passageway;

(b) a first disk of the selected diameter may be retained in the first passageway in a manner such that, upon attempted rotation of the director, the first disk will not release the rotational blocking means, and such that upon insertion of a second disk of substantially the same selected diameter in the director opening the first disk can support the second disk such that the second disk projects peripherally outwards from the director so that upon attempted rotation of the director with both the first and second disks therein the second disk then can release the rotational blocking means; and the director also having a second passageway extending from the opening which is sized and constructed such that when said first disk is in said first passageway and a disk of below the selected diameter is inserted in the opening, it will pass through the second passageway.

* * * * *

UNITED STATES PATENT AND TRADEMARK OFFICE

CERTIFICATE OF CORRECTION

PATENT NO. : 5,174,427

DATED : December 29, 1992

INVENTOR(S) : Robert L. Glaser

It is certified that error appears in the above-identified patent and that said Letters Patent is hereby corrected as shown below:

In line 56 of column 4, "blacking" should be --blocking--.

Signed and Sealed this

Twenty-sixth Day of October, 1993

*Attest:*

Bruce Lehman

BRUCE LEHMAN

*Attesting Officer*

*Commissioner of Patents and Trademarks*